United States Patent [19]

Chaddock, deceased et al.

[11] Patent Number: 4,984,743

[45] Date of Patent: Jan. 15, 1991

[54] PESTICIDE SPRAY NOZZLE

[75] Inventors: James D. Chaddock, deceased, late of Midland; Perry Chaddock, executor, Sanford, both of Mich.

[73] Assignee: The Dow Chemical Company, Midland, Mich.

[21] Appl. No.: 345,278

[22] Filed: Jan. 17, 1989

Related U.S. Application Data

[63] Continuation of Ser. No. 18,325, Feb. 24, 1987, abandoned, which is a continuation-in-part of Ser. No. 718,611, Apr. 1, 1985, Pat. No. 4,662,565, which is a continuation-in-part of Ser. No. 592,776, Mar. 26, 1984, abandoned.

[51] Int. Cl.[5] ..... B05B 1/14

[52] U.S. Cl. ..... 239/559; 239/565; 239/567

[58] Field of Search ..... 239/556–559, 239/565–567; 285/132, 155

[56] References Cited

U.S. PATENT DOCUMENTS

| | | | |
|---|---|---|---|
| 172,467 | 1/1876 | Melcher | 239/567 X |
| 910,400 | 1/1909 | Lischer . | |
| 2,185,278 | 1/1940 | Stephens | 239/567 |
| 2,511,969 | 9/1945 | Chapin | 299/62 |
| 2,576,435 | 11/1951 | Bachrach | 239/565 X |
| 2,680,652 | 6/1954 | Kooistra | 239/565 X |
| 2,857,204 | 1/1958 | Gross | 239/559 X |
| 2,858,836 | 8/1958 | Geh et al. | 134/167 |
| 3,170,264 | 8/1961 | Waldrum | 43/145 |
| 3,199,786 | 8/1965 | Waldrum | 239/223 |
| 3,220,653 | 11/1965 | Waldrum | 239/97 |
| 3,285,516 | 6/1966 | Waldrum | 239/102 |
| 3,399,638 | 6/1967 | Waldrum et al. | 111/6 |
| 3,523,646 | 8/1968 | Waldrum | 239/171 |
| 3,642,206 | 2/1972 | Waldrum | 239/214 |
| 3,648,935 | 3/1972 | Waldrum | 236/659 |
| 3,653,598 | 4/1972 | Waldrum | 239/229 |
| 3,931,930 | 1/1976 | Waldrum | 239/7 |
| 4,231,520 | 11/1980 | Waldrum | 239/171 |
| 4,351,478 | 9/1982 | Looper | 239/227 |
| 4,662,565 | 5/1987 | Waldrum | 239/236 |

FOREIGN PATENT DOCUMENTS

| | | | |
|---|---|---|---|
| 409247 | 9/1966 | Switzerland | 239/565 |
| 612864 | 6/1946 | United Kingdom . | |

*Primary Examiner*—Andres Kashnikow
*Assistant Examiner*—William Grant
*Attorney, Agent, or Firm*—Edward E. Schilling; Ronald G. Brookens

[57] ABSTRACT

A spray nozzle which comprises a generally solid body having substantially parallel opposed faces and a circumferential edge, at least a portion of the circumferential edge describing an arcuate face;

a major-sized borehole extending normally into the circumferential edge from a direction opposite the arcuate face and substantially transversely through the solid body;

a plurality of angularly arrayed minor-sized boreholes intersecting the major-sized borehole and extending through the arcuate-faced edge of the solid body, the minor-sized boreholes each having an axis intersecting substantially perpendicular to a borehole face of the major-size borehole closest to the arcuate-faced edge;

a spray outlet tube mounted in each of the minor-sized boreholes; and means for coupling the major-sized borehole to a source of liquid pest control composition under operable pressure for spraying.

8 Claims, 6 Drawing Sheets

PESTICIDE SPRAY NOZZLE

RELATIONSHIP TO PRIOR APPLICATION

This is a continuation of U.S. application Ser. No. 018,325, filed Feb. 24, 1987, now abandoned which is a continuation-in-part of application Ser. No. 718,611, filed Apr. 1, 1985, now U.S. Pat. No. 4,662,565; which is in turn a continuation-in-part of application Ser. No. 592,776, filed Mar. 26, 1984 and now abandoned.

BACKGROUND OF THE INVENTION

1. Field of the Invention

The invention relates to a spray nozzle for the spraying of a pesticide such as a herbicide, for example, along a swath beside a highway or railroad track bed while the spraying equipment adopted for such spray nozzle is carried on a mobile platform. The device is useful for land-based or aerial spraying of industrial property, rights of way, agricultural lands and forest lands, wherever the mobile platform, or spray vehicle, can go as a practical matter. The greatest usefulness is believed to be in the spraying at rights of way.

2. Description of the Prior Art

Applicators using spraying equipment in any such setting must be concerned with achieving adequate coverage of the swath width, sometimes as wide as 40 to 60 feet, while avoiding the formation of fine droplets which are easily carried by slight air movement resulting in "drift" beyond the target area.

Generally attempts to avoid formation of fine droplets while yet achieving uniform coverage of the target area have been directed to moving the discharge nozzle, and/or its support, in a special rotational or oscillational pattern, as well as using specific nozzle orifice designs which minimize the formation of mists and fine droplets. Some of these devices present problems in service life and difficulties in servicing or in achieving uniformity of coverage.

Various approaches are to be found in the devices more fully described in my earlier patents U.S. Pat. Nos. 4,231,520, 3,931,930 and 3,642,206. Other spraying apparatus is described in my earlier patents U.S. Pat. Nos. 3,653,598; 3,648,935; 3,523,646; 3,399,638; 3,285,516; 3,220,653; 3,199,786 and 3,170,264.

SUMMARY OF THE INVENTION

A spray nozzle which comprises a generally solid body having substantially parallel opposed faces and a circumferential edge, at least a portion of said circumferential edge describing an arcuate face;

a major-sized borehole extending normally into said circumferential edge from a direction opposite the arcuate face and substantially transversely through the solid body;

a plurality of angularly arrayed minor-sized boreholes intersecting said major-sized borehole and extending through the arcuate-faced edge of said solid body, said minor-sized boreholes each having an axis intersecting substantially perpendicular to a borehole face of the major-size borehole closest to the arcuate-faced edge;

a spray outlet tube mounted in each of said minor-sized boreholes; and means for coupling the major-sized borehole to a source of liquid pest control composition under operable pressure for spraying.

Preferably, the minor boreholes and outlet tubes are aligned in at least two separate, substantially parallel planes. Also preferred is that the minor boreholes and outlet tubes are angularly arranged at an angle not greater than about 90 degrees. Also preferred is that about one half of the minor boreholes and outlet tubes lie alternately in each plane. In another preferred embodiment, the solid body is substantially a thick discate section of a cylinder. In yet another preferred embodiment, the axis of the major-sized borehole is substantially equidistant from and parallel to each opposed face. The nozzle of the present invention has the advantage of delivering pesticide spray compositions along a strip of land to be sprayed, e.g., a railroad track or a highway right of way in a swath up to at least 50 feet wide upon the adjacent right of way with minimal spray drift problems. Another advantage of the present nozzle is that it delivers a solid liquid stream with few small particles generated thereby, to permit a more precise delivery to the target. And still yet another advantage is that the nozzle reduces turbulence inside the spray nozzle body which would otherwise result in small particle generation (i.e., drift) at the nozzle outlet.

THE DRAWINGS

FIG. 1 is a view in side elevation of the novel spray apparatus employing the nozzle and fluid discharge means pivoting mechanism of the invention;

FIG. 2 is an enlarged end view taken along line 2—2 of FIG. 1 partly in section and with the cover plate removed along with the ball socket bearing mount supported thereby, exposing to view the pivoting mechanism consisting of a motor driven disc wheel, a connecting rod carried thereby, an oscillatable guide through which the connecting rod reciprocates, and a yoke and cap surrounding flexible liquid conduit means, the yoke being connected to the connecting rod;

MORE DETAILED DESCRIPTION OF THE INVENTION

Figure 1:
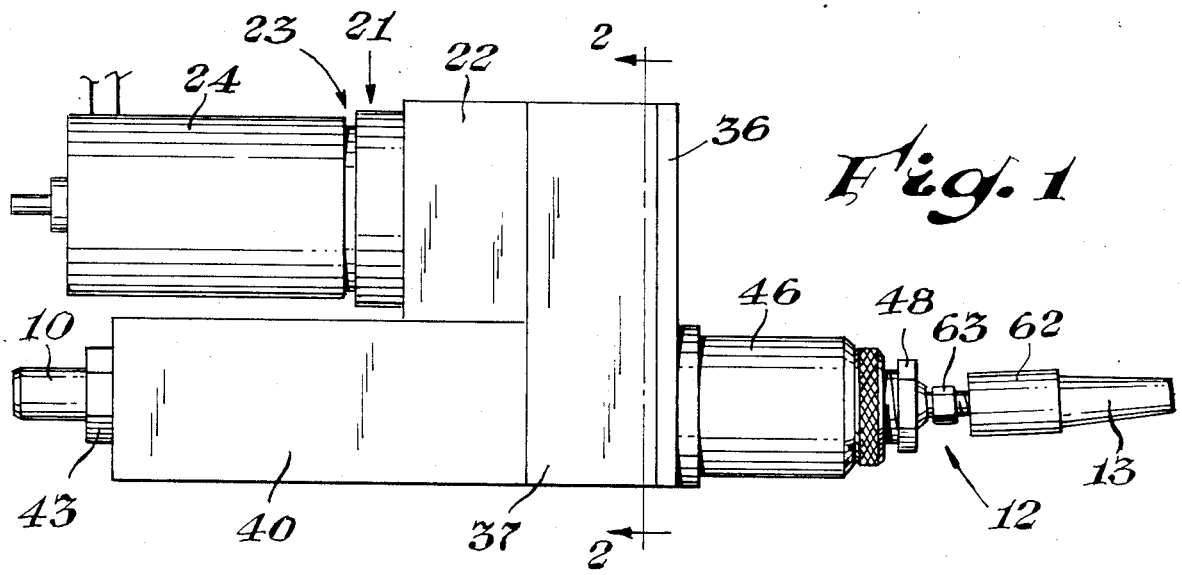
Figure 5:
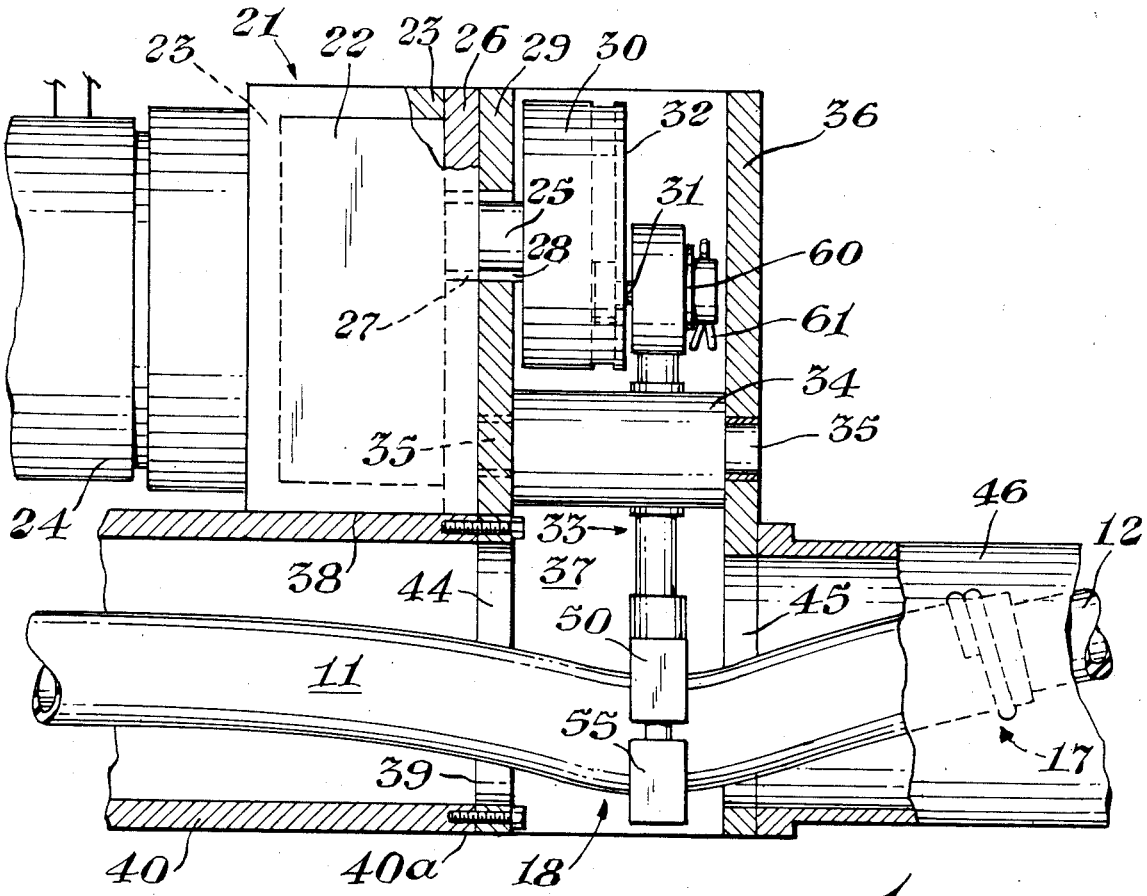
FIG. 5 is an enlarged fragmentary side view, partly broken away and in section, of the spray apparatus of FIG. 1, showing the relationship of the oscillatory mechanism to the flexible liquid conduit means with the connected portion of the flexible spray liquid conduit means in a laterally displaced condition.
Figure 6:
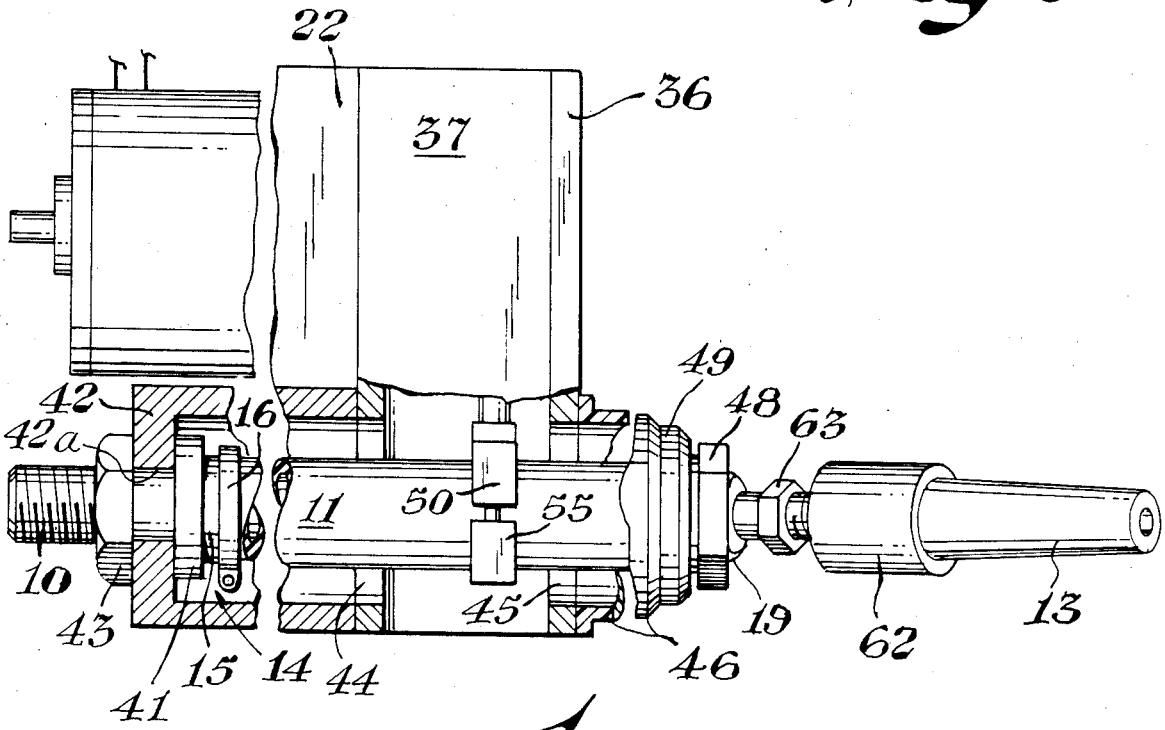
FIG. 6 is an enlarged foreshortened side view, partly broken away and in section, of the spray apparatus of FIG. 1, showing the electric motor drive means and the relationship of the rigid spray composition supply means to the flexible liquid conduit means, the relationship of the latter to the pivotal fluid discharge means and nozzle connected thereto being set forth in greater detail in FIG. 10.
Figure 10:
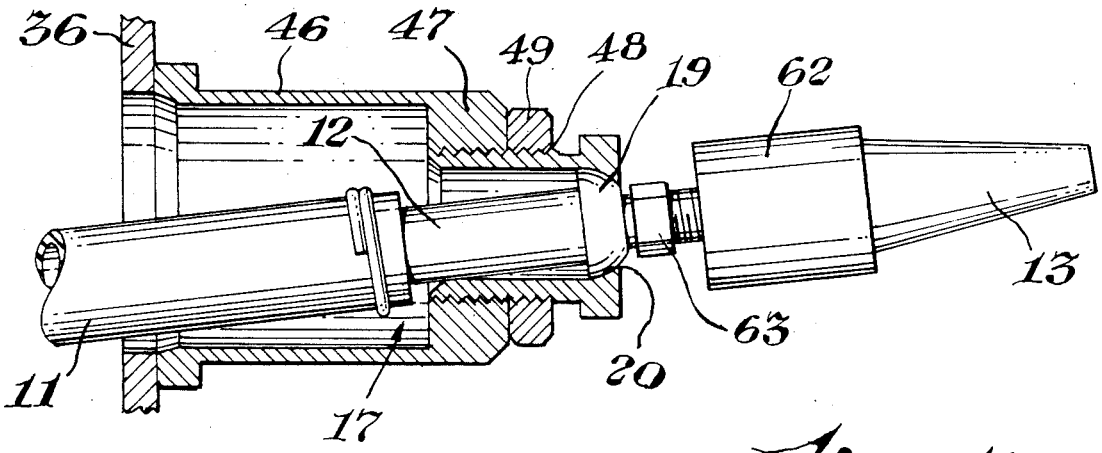
FIG. 10 is an enlarged fragmentary side view, partly in section, showing the flexible liquid conduit means connected to the pivotal rigid fluid discharge means having a partial ball portion and the relationship of the latter to the ball socket bearing and the mount therefor, and a nozzle attached to the rigid fluid discharge means.

Referring to FIGS. 1, 5, 6 and 10, one embodiment of the spray applicator of the invention is seen to include a composite liquid supply means made up of a rigid tubular member 10 connected as shown in FIG. 6, to a flexible tubular member 11, which interconnects the fixed rigid tubular member 10 and a pivotal rigid tubular member indicated generally by the reference numeral 12, as shown more particularly in FIG. 10. In turn, the pivotal rigid tubular member 12 is connected to the nozzle means 13, here a single nozzle, as shown in FIGS. 1, 6 and 10.

The fixed rigid tubular member 10 is to be understood to be adapted to be connected by liquid conduit means to the discharge side of a pump drawing sprayable liquid pesticide composition from a tank mix thereof at a controllable rate, all of which is conventional and well understood and is not illustrated herein.

Referring now to FIG. 6, it is essential that the said composite liquid supply means be fixedly supported adjacent the coupling, indicated generally by the reference numeral 14, of the flexible tubular member 11 to the rigid tubular member 10. The coupling shown consists of the end portion 15 of the flexible tubular member 11 slipped over the end portion of rigid tubular member 10 and retained in such concentric relation by compression of clamp 16. If desired, the end portion of rigid tubular member 10 may be formed or manufactured with a series of external circumferential ridges (not shown) as well understood in the art to better grip the flexible tubular member 11.

It is essential that the said composite liquid supply means consist of a main central flexible tubular portion or member 11 fixedly supported adjacent an end thereof and pivotally supported about a fixed point adjacent the other end, and further, that the linear spacing between the coupling 14 to the fixed rigid tubular member 10 and the coupling 17 to the pivotal rigid tubular member 12, seen in FIGS. 5 and 10, be sufficiently less than the length of the flexible tubular member 11 that a portion 18 of the latter, as shown in FIG. 5, is forced to bend and displace laterally, thus holding the pivotal rigid tubular member 12 at an angle of from about 1 to about 35 degrees, preferably from about 5 to about 15 degrees and most preferably about 10 degrees from a straight line drawn through the linear axis of the fixed rigid tubular member 10 to the axis of the pivotal rigid tubular member 12 at the point of pivotal support where an outer wall portion 19 of the pivotal rigid tubular member 12, as seen in FIG. 10, is formed in the shape of a partial ball, i.e., in the shape of a segment of a sphere between the equator and polar region thereof, and is supported by a mating, complementary ball socket bearing 20, the smallest diameter portion of which is most remote from the flexible tubular member 11.

It is not critical whether it is the fixed rigid tubular member 10 or the flexible tubular member 11 which is fixedly supported adjacent the coupling 14 between those members.

Figure 11:
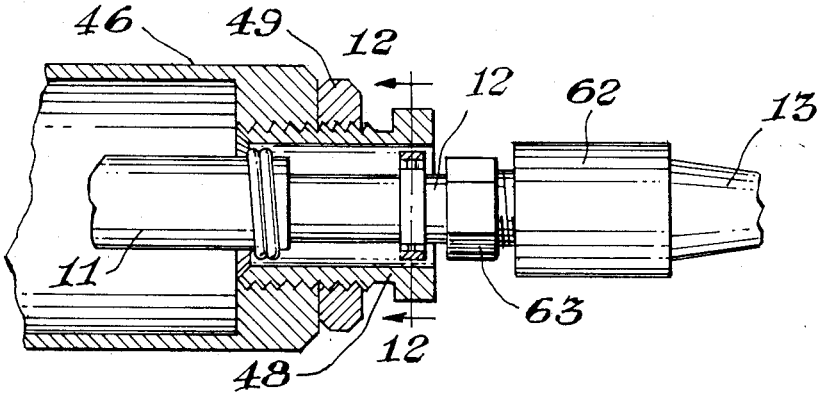
FIG. 11 is a view partly in full and partly in section of a fragmentary portion of a view similar to FIG. 10 but of an alternate embodiment having a gimballed support instead of partial ball and a ball socket bearing.
Figure 12:
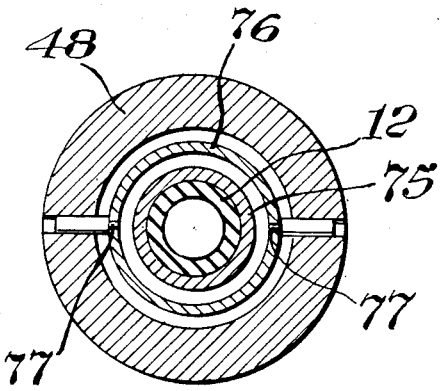
FIG. 12 is a greatly enlarged view taken along the line 12—12 of FIG. 11 further illustrating the gimballed structure.

If desired, in an alternative embodiment, there may be employed a gimballed structure such as illustrated in FIGS. 11 and 12 instead of the partial ball 19 and ball socket bearing 20 combination previously shown, in order to provide universally pivotal support about a fixed point for the pivotal rigid tubular member 12. The pivotal rigid tubular member 12 is seen in FIG. 12 to immediately be surrounded by the inner ring 75 of the gimbal. Ring 75 pivots within ring 76 which in turn pivots on pins 77 which extend inwardly from sleeve 48 in the bearing mount 46.

In order to accomplish one of the principal objectives of the inventions, there is provided means for controllably continuously moving the laterally displaced portion 18 of the flexible tubular member 11 about a circular path substantially centered around said axis defined by a straight line drawn between the linear axis of the fixed rigid tubular member 10, and, the axis of the pivotal rigid tubular member 12 at its point of pivotal rotation.

Referring now more particularly to FIG. 5, such means can conveniently take the form of electric motor drive means 21 consisting of a conventional gear reduction assembly 22 housed in a body shell 23 and powered by an electric motor 24 and having an electric power source, not shown. The type of power used is not critical and instead of an electric motor there may be used a hydraulic motor powered by a hydraulic pump driven in conjunction with the drive for the mobile platform, or an internal combustion engine may be used. Wherein 24 is a hydraulic motor, lines 24*a* and 24*b* are understood to be hydraulic lines and wherein 24 is an internal combustion engine, 24*a* and 24*b* are understood to be fuel lines. Generally no gear reduction assembly is required if a hydraulic motor is used as a power source for the apparatus. A power shaft 25 extends through the end wall 26, shown in dotted outline, of the body shell 23 and is journalled therein in bearing 27.

Figure 13:
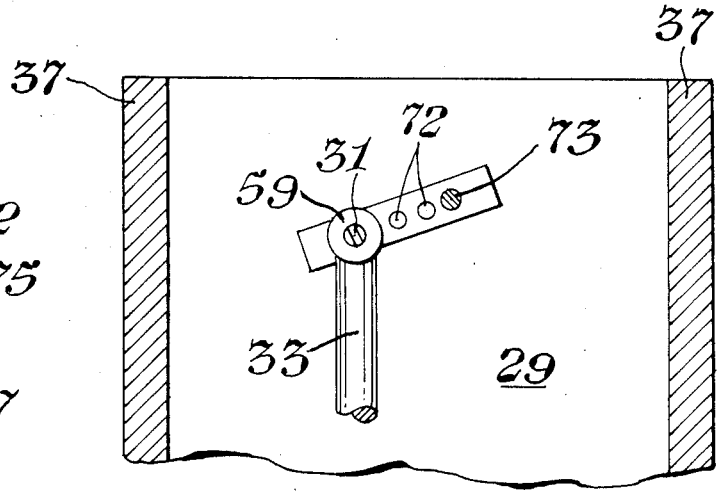
FIG. 13 is a fragmentary end view of the present device with the cover plate 29 removed as in FIG. 2, but showing another embodiment of the present apparatus in which an adjustable crank is employed instead of a disc wheel to impart reciprocal motion.

The power shaft extends further beyond the body shell 26 and through an aperture 28 in backing plate 29 and mounted thereon adjacent the end thereof is a disc wheel 30. In place of the disc wheel 30, a crank may be used as shown in FIG. 13, preferably, an adjustable crank. The disc wheel may be considered as a special form of crank which is simply a means for transforming circular motion into reciprocal motion. A wrist pin 31 extends perpendicularly from the outward face 32 of the disc wheel 30 at a location radially outwardly from the axis of rotation. Rotatably mounted on the wrist pin 31 is a connecting rod indicated generally by the reference numeral 33.

Figure 2:
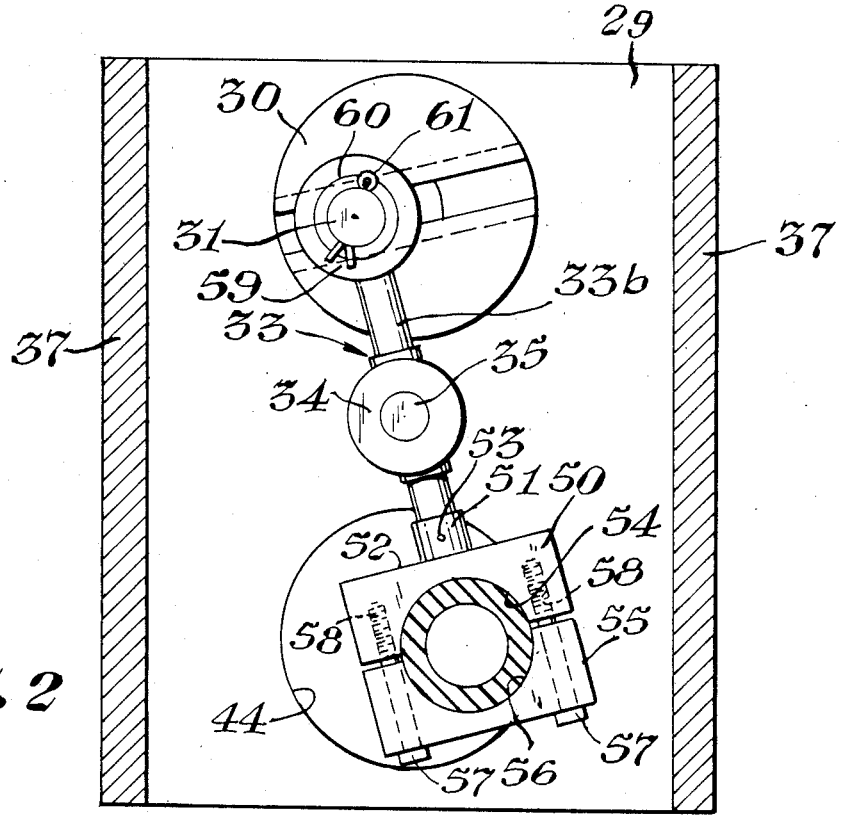
Figure 4:
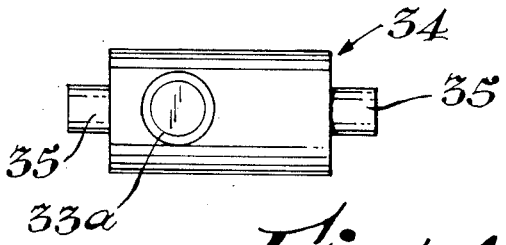
FIG. 4 is a side view of the guide through which the connecting rod reciprocates.

As seen with greater particularity in FIGS. 2 and 5, the connecting rod 33 at about its mid-section extends slideably through a cylindrical borehole 33*a* extending through an oscillatable guide 34. The oscillatable guide 34, shown separately in FIG. 4, is supported at its ends by axial pins 35, e.g., as shown in FIG. 5. The oscillatable guide 34 extends perpendicularly from the backing plate 29 and is rotatably journalled therein at one end and at the other end in a cover plate 36 which is spaced apart from and generally coextensive with the backing plate 29. The backing plate 29 and the cover plate 36 are rigidly attached and spaced apart, e.g., by virtue of the backing plate being a channel member with longitudinally extending lateral flanges 37 to which the cover plate 36 mates and is mounted by conventional mounting means (not shown), such as bolts traversing apertures in plate 36 and threading into tapped holes in flanges 37, the flanges being of sufficient width to provide space for the disc wheel 30 and connecting rod 33 and rotatable guide 34 to function. If desired, the lateral flanges 37 may be formed integrally with the cover plate 36 instead of with the backing plate, or one flange with each plate.

The backing plate 29 and the cover plate 36 are normally coextensive and extend substantially beyond the side or edge 38 of the gear reduction assembly 22 and together constitute main support elements of the apparatus. Mounted on that face 39 of the backing plate 29 which faces away from the cover plate 36 is an end **40*a* of an elongated sleeve 40 which may be hollow rectangular as shown, or cylindrical in form, and is positioned substantially parallel and closely adjacent to the electric motor drive means 21**.

As seen in FIGS. 1, 5 and 6, the fixed rigid tubular member 10 and flexible tubular member 11 portion of the composite liquid supply means are largely enclosed within the elongated sleeve 40 and the adjacent spacing between the backing plate 29 and the cover plate 36. Referring particularly to FIG. 6, the fixed rigid tubular member 10 is shown to be provided with a circumferential integrally formed or attached boss or collar portion 41 against which the overlapping portion of the flexible tubular member typically is stopped in making the coupling 14. An important function of the boss 41 is to restrain the fixed rigid tubular member 10 from sliding axially out of the sleeve member 40 through the aperture **42*a* in the end wall 42 of the elongated sleeve 40 through which the rigid tubular member 10 extends. The portion of the rigid tubular member 10 which extends outside the elongated sleeve 40 is externally threaded and a nut 43 tightened against the end wall 42 holds the rigid tubular member 10 firmly in a fixed position, providing fixed support adjacent an end of the flexible tubular member 11**.

The flexible tubular member 11 extends along the sleeve 40 and through relatively large respective apertures 44, 45 in the backing plate 29 and the cover plate 36. The apertures 44, 45 are generally aligned with the axis of the elongated sleeve 40 and are of adequate diameter to provide for the requisite range of lateral displacement widths desired of the displaced portion 18 of the flexible tubular member 11 required as illustrated especially in FIG. 5.

Reference is made to FIGS. 5 and 10 wherein the details of pivotal support of the other end of the composite liquid supply means are further illustrated. The flexible tubular member 11 extends also through said aperture 45 in the cover plate 36 and into a ball socket bearing mount 46 which is conveniently hollow cylindrical in form and is rigidly attached to the cover plate 36 in substantial alignment with and of greater diameter than the aperture 45. The flexible tubular member 11 terminates in the coupling 17 in which it overlaps and is slipped onto the end portion of the pivotal rigid tubular member 12.

The ball socket bearing mount 46 is provided with a partial closure in the form of a relatively thick end wall 47 having an internally threaded aperture in which is threadably received an externally threaded smaller sleeve member 48 having a partial ball socket bearing surface or socket 20 formed in the end wall thereof and having an aperture formed therethrough. Locking nut 49 upon the smaller sleeve member 48 may be tightened against the end wall 47 of the ball socket bearing mount 46 to hold the ball socket bearing sleeve 48 firmly in a preselected axial, i.e., longitudinal, position.

The partial ball portion 19 of the pivotal rigid tubular member 12 bears against the surface of the ball socket bearing 20 from the direction of the flexible tubular member 11 and is held thereagainst by the axially directed thrust of the flexible tubular member 11, which essentially must be sufficiently confined longitudinally to cause lateral displacement of the displaced portion 18. The length and diameter of the smaller sleeve member 48 are selected according to well understood principles of geometry to accommodate movement of the laterally displaced portion 18 of the flexible tubular member 11, and the proportionately displaced portions of the remainder of the flexible tubular member 11 and the attached pivotal rigid tubular member 12 inside the smaller sleeve member 48. The more lateral displacement desired, the shorter the sleeve member 48 must be and/or its internal diameter must be enlarged to accommodate the greater geometry.

Figure 14:
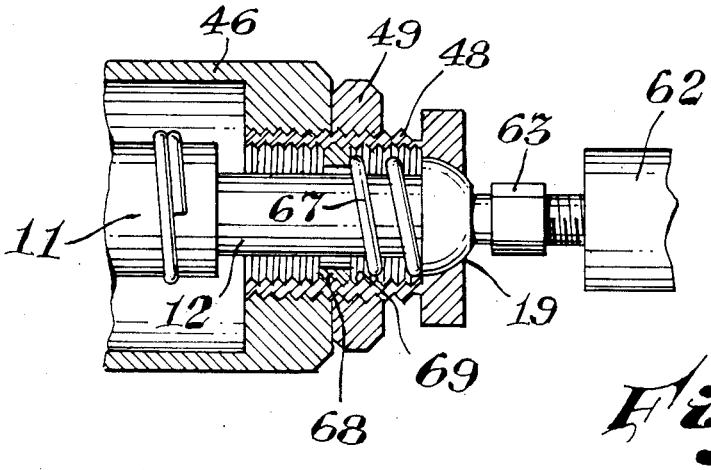
FIG. 14 is an enlarged fragmentary portion of a view in side elevation, partly in section and partly in full, similar to FIG. 10 but showing a collar and spring means for urging the partial ball against the ball socket bearing.
Figure 15:
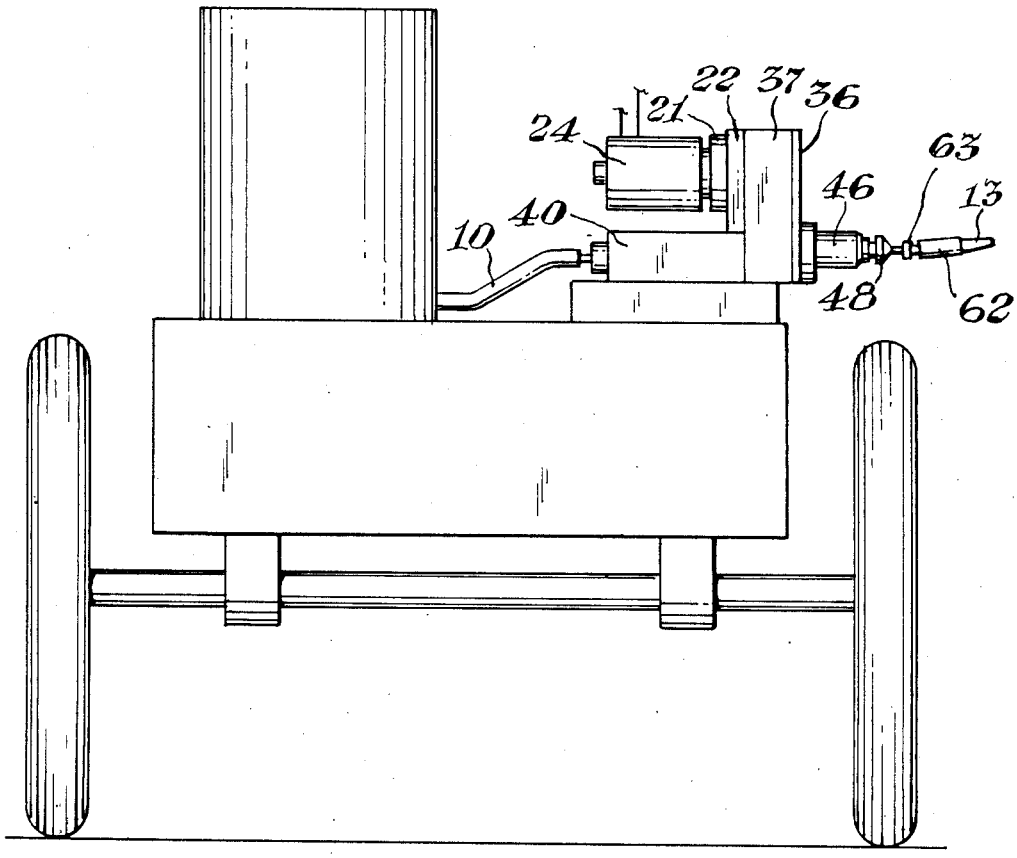
FIG. 15 is a plan view of the spray applicator device of the invention mounted on a mobile platform along with spray composition supply means.

If desired, the partial ball portion 19 of the pivotal rigid tubular member 12 may be urged against the ball socket bearing 20 as shown in FIG. 14 by a compressed cylindrically wound spring 67 circumferential to the shank of the pivotal rigid tubular member 12 and retained inside the smaller sleeve member 48 as by a collar 68 internally threaded into the said smaller sleeve member 48 which must be provided with internal threads 69.

The ball and ball socket bearing assembly described provides pivotal support for the rigid tubular pivotal support member 12 about a fixed position adjacent an end of the flexible tubular member 11.

Referring now to FIGS. 5 and 6 the laterally displaced portion 18 of the flexible tubular member 11, at the portion of greatest lateral displacement, is caused to rotate in a circular motion substantially concentric to a line drawn between the said axis of the fixed rigid tubular member 10 where coupled to the flexible tubular member 11 and the axis of the pivotal rigid tubular member 12 at the location of the partial ball 19 and ball socket bearing 20 assembly by the action of the connecting rod 33. The connecting rod 33, as indicated, extends reciprocatably through the oscillatable guide 34 and thence towards the flexible tubular member 11 as the latter extends through the apertures 44, 45 in the backing plate 29 and cover plate 36, respectively, and is attached to the flexible tubular member 11 by any suitable means. Conveniently, attachment may be by means of a yoke 50 in the form of a generally rectangular plate with a sleeve 51 extending from one edge 52 to receive the end of the connecting rod 33 attached therein as with a pin 53. The other edge 54 of the yoke 50 has a substantially semicircular concavity formed therein to receive the flexible tubular member 11 thereagainst. A mating cap 55 with a semicircular concavity 56 formed in an edge thereof is attached to the yoke 50 so as to embrace and grasp the flexible tubular member 11 when the cap 55 is tightened and held firmly to the yoke 50, as by bolts 57 extending transversely through the cap 55 from edge to edge and into tapped holes 58 in the yoke 50 adjacent the concavity thereof.

Rotation of the disc wheel 30 by the electric motor drive means 21 or other power drive means causes reciprocation of the shank **33*b* of the connecting rod 33 through the oscillatable guide 34 and angular oscillatory movements of the connecting rod 33 about the axis of the oscillatable guide 34 resulting in the yoke 50 and cap 55 assembly and the portion 18 of the flexible tubular member 11 grasped thereby reproducing the circular path motions of the enlarged end portion 59 of the connecting rod 33 carried rotatably by the wrist pin 31 in the face of the disc wheel 30, but proportionately as to the radius of such circular motions as determined by the relative spacings (1) from the wrist pin 31 to the axial pins 35 of the oscillatable guide 34 on the one hand and (2) from the said axial pins to the radial center of the concavity of the yoke 50** on the other hand. The shorter the first spacing the greater the diameter of the second circle by comparison, and vice versa, the longer the first spacing the smaller the diameter of the second circle.

Adjustment of the diameter of the circular path of the laterally displaced portion 18 of the flexible tubular member 11 is readily obtained, for example, by making provision to relocate the wrist pin 31 on the face of the disc wheel 30 at a preselected radial distance from the axis of the disc wheel by any suitable means, e.g., by providing tapped holes in the disc wheel at preselected locations in the disc wheel face.

Figure 3:
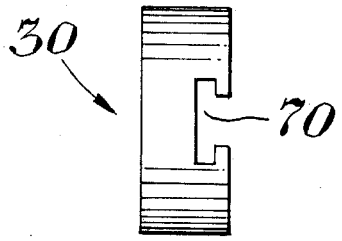
FIG. 3 is an enlarged side view of the motor driven disc wheel.

The disc wheel 30 shown in FIGS. 2, 3 and 5 is provided with a diametrically disposed undercut slot 70 milled thereinto, the slot being T-shaped in section and adapted to hold the polygonal head of a wrist pin 31, the shank of which extends perpendicularly from the face of the disc wheel 30 and carries the said enlarged end 59 of the connecting rod 33 thereon rotatably, the enlarged end being retained by any suitable means such as a washer 60 and cotter key 61 or a washer with a retaining nut (not shown) threaded into the wrist pin 31.

On adjusting the mounting of the wrist pin 31 closer to the axis of the disc wheel 30, the diameter of the circular path followed by the laterally displaced portion 18 of the flexible tubular member 11 is proportionately reduced and conversely if the wrist pin 31 is mounted further from the said axis.

If desired, an adjustable crank 71, as shown in the embodiment illustrated in FIG. 13, may be used in place of the disc wheel 30 and holes 72 provided therethrough for mounting the pin 31 at a preselected distance from the axis of rotation 73 of the adjustable crank 71. The disc wheel 30 serves as a special form of adjustable crank.

By the original design of the equipment, then, i.e., preselecting the relative length of the connecting rod 33 from the axis of the oscillatable guide 34 to the wrist pin 31, as contrasted to the length from said axis to the radial center of the concavity of the yoke 50, and by the adjustment of the radial location of the wrist pin 31 from the axis of rotation of the disc wheel 30 or the adjustable crank 71, the extent of pivoting of the nozzle means 13 of the present apparatus is selected and controlled to give the kind of spray pattern desired.

Referring more particularly to FIGS. 6 and 10, the pivotal rigid tubular member 12 is provided externally of the partial ball and ball socket bearing assembly with means for attaching the nozzle means 13 in fluid communication therewith. Generally, the pivotal support member 12 is externally threaded and an externally threaded nozzle or nozzle assembly 13 is connected end to end thereto with an internally threaded coupler 62. Conveniently, the pivotal support member 12 is provided with a polygonal boss portion 63 generally hexagonally formed circumferentially in the outer wall allowing ready use of a wrench to restrain rotation of the pivotal rigid tubular member while connecting or disconnecting the nozzle or nozzle assembly 13. The polygonal base portion 63 is not essential to employ, but if used, must be small enough to pass through the aperture in partial ball socket 20. If desired, such polygonal element need not be integrally formed with the rigid tubular member 20, but may be a separate element sweated or glued or tightly wedged thereonto e.g., after assembly of the entire composite liquid conduct means in and through the bearing mount 46, and the sleeve 48.

Figure 9:
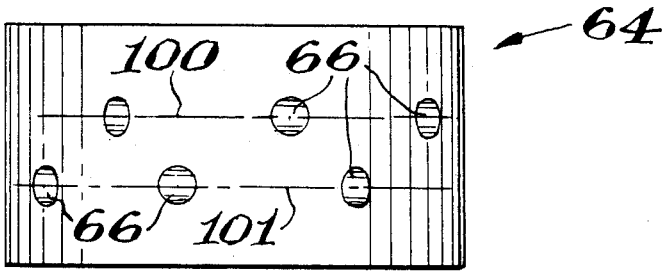
FIG. 9 is a side view of the multiple-port nozzle depicted in FIG. 7 as viewed from the fluid discharge side with the individual outlet tubes removed.
Figure 8:
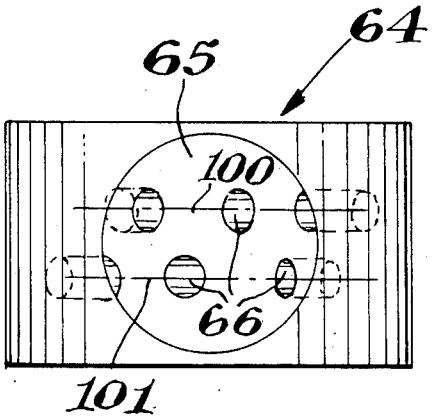
FIG. 8 is a side view of the multiple-port nozzle depicted in FIG. 7 as seen from the fluid inlet side with the individual outlet tubes removed.
Figure 7:
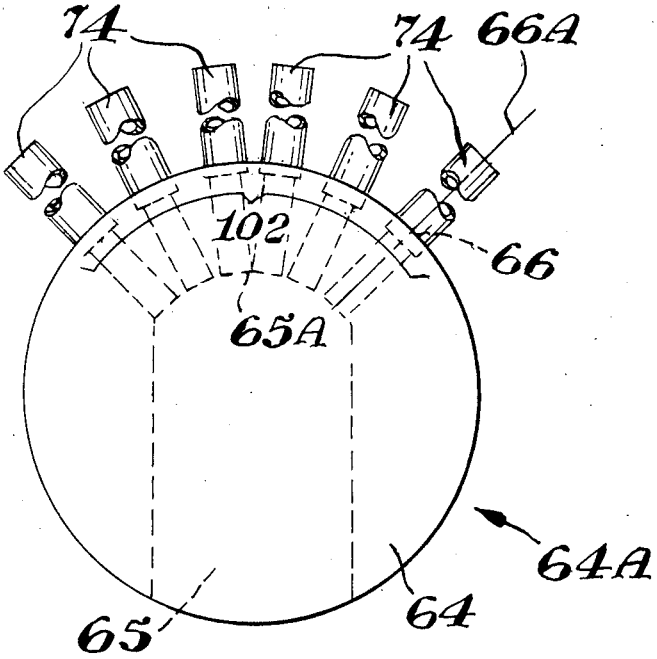
FIG. 7 is a greatly enlarged foreshortened top view of a multiple-port nozzle, suitable for use with the present orbital action spraying device.

Referring to FIG. 7, nozzle 64A is intended to provide a columniation spray (i.e., solid stream radial pattern). Nozzle 64A is made of an array of spray outlet tubes 74 mounted in a manifold. Such an array is readily provided in the form shown in FIGS. 7, 8 and 9 in which a discate body 64 that is relatively thick in comparison to its diameter is provided with a major inlet borehole 65 bored out or formed, centered at approximately mid-thickness, from one edge along a generally diametric line to a depth sufficient to intersect radially inward minor outlet boreholes 66 which are in an array encompassed within a sector defined by arcuate face edge 102 not greater than about a 90 degrees spread. Individual spray outlet tubes 74 are mounted in respective boreholes 66. Each minor borehole 66 has an axis 66A intersecting substantially perpendicular to borehole face 65A closest to arcuate faced edge 102. It has also been found advantageous in achieving a good spray pattern to arrange minor boreholes 66 substantially parallel and alternately along two or more separate planes 100 and 101 as shown in FIGS. 8 and 9. The discate body 64 can be mounted on the pivotal rigid tubular member 12 by any suitable means, e.g., by internally threading major borehole 65 which mates with the externally threaded distal end of the pivotal support member 12 or by the use of any conventional adapter means.

The apparatus is readily made from conventionally used materials of construction such as any of mild steel, aluminum or aluminum alloy or an alloy steel for the backing plate, cover plate, disc wheel, connecting rod, rotatable guide, elongated sleeve and ball socket bearing and ball socket bearing mount, butyl rubber tubing for the flexible tubular member, and molded nylon or rigid polypropylene or other polyalkylene for the fixed rigid tubular member, pivotal rigid tubular member, and nozzle holder or assembly body.

In practicing the method of the present invention in which a liquid pesticide composition is sprayed along a swath of substantially predetermined width, a mobile platform, such as a railroad car or a highway truck, or other vehicle as may be appropriate, is provided having the present spray apparatus thereon and means for supplying the liquid pesticide composition thereto, including a supply tank and a pump, drive means for the pump, and the requisite liquid supply conduit in the form of connecting piping and or flexible hose portions leading to the spray apparatus. The spray apparatus, as indicated hereinabove, is provided with nozzle means and liquid supply conduit means operatively interconnecting the said liquid supply conduit and the nozzle means.

The interconnecting liquid supply conduit means includes a flexible portion and a rigid portion, the latter connecting the flexible portion to the nozzle means and being pivotally supported between its ends and being pivotal about a fixed point whereby the distal end, i.e., discharge end, of the nozzle means describes a circular path. Means is provided for controllably continuously pivoting the said rigid portion of the liquid supply conduit means at a preselected angular momentum whereby the distal end of the nozzle means moves in a circular path, preferably at a rate in the range of about 50 to about 150 revolutions per minute, although in applications where there is less concern for spray drift the said rigid portion may be pivoted more rapidly and good, even distribution of spray composition may be attained along a swath of moderate to narrow width.

Among the advantages of the present apparatus is the absence of any rotating seals and attendant maintenance problems.

I claim:

1. A spray nozzle assembly for spraying a swath up to 50 feet in width which comprises a generally solid body having substantially parallel opposed faces and a circumferential edge, at least a portion of said circumferential edge describing an arcuate face;

a major-sized borehole extending normally into said circumferential edge from a direction opposite the arcuate face and substantially transversely into but not through the solid body, the borehole terminating in an end face within the solid body;

a plurality of angularly arrayed minor-sized boreholes intersecting the end face of said major-sized borehole and extending through the arcuate-faced edge of said solid body, said minor-sized boreholes each having an axis intersecting the major-sized borehole end face substantially perpendicular to the end face, the minor-sized boreholes communicating with the major-sized borehole;

a spray outlet tube adapted to deliver a solid liquid stream mounted in each of said minor-sized boreholes; and means for coupling the major-sized borehole to a source of liquid pest control composition under operable pressure for spraying.

2. The spray nozzle assembly as in claim 1 in which the minor-sized boreholes and outlet tubes are aligned in a common plane.

3. The spray nozzle assembly as in claim 1 in which the minor-sized boreholes and outlet tubes are aligned in at least two substantially parallel planes.

4. The spray nozzle assembly as in claim 1 in which the minor-sized boreholes and outlet tubes are angularly arrayed at an angle not greater than about 90 degrees.

5. The spray nozzle assembly as in claim 3 in which about one half of the minor-sized boreholes and outlet tubes lie alternately in each plane.

6. The spray nozzle assembly as in claim 1 in which the solid body is substantially a thick discate section of a cylinder.

7. The spray nozzle assembly as in claim 1 in which the axis of the major-sized borehole is substantially equidistant from and parallel to each opposed face.

8. The spray nozzle assembly as in claim 1 in combination with means for pivoting the nozzle assembly in a circular path while supplying pesticide composition thereto.

* * * * *